United States Patent [19]

Albert

[11] 4,248,191

[45] Feb. 3, 1981

[54] METHOD AND MEANS FOR PREVENTING VALVE BRIDGE CRACKS IN CYLINDER HEADS OF INTERNAL COMBUSTION ENGINES

[75] Inventor: Max Albert, Nuremberg, Fed. Rep. of Germany

[73] Assignee: Maschinenfabrik Augsburg-Nürnberg Aktiengesellschaft, Nuremberg, Fed. Rep. of Germany

[21] Appl. No.: 37,024

[22] Filed: May 8, 1979

[30] Foreign Application Priority Data

May 9, 1978 [DE] Fed. Rep. of Germany ..... 2820149

[51] Int. Cl.[3] ..... F02F 1/24

[52] U.S. Cl. ..... 123/188 S; 123/193 H

[58] Field of Search ..... 123/188 S, 193 H, 41.85, 123/193 R

[56] References Cited

U.S. PATENT DOCUMENTS 2,716,969 9/1955 Lang ..... 123/41.8 S 3,115,127 12/1963 Spencer et al. ..... 123/188 S

FOREIGN PATENT DOCUMENTS 2061930 7/1972 Fed. Rep. of Germany ... 123/193 M

*Primary Examiner*—Craig R. Feinberg

*Attorney, Agent, or Firm*—Becker & Becker, Inc.

[57] ABSTRACT

Method and device to prevent valve bridge cracks in the cylinder head of internal combustion engines. The cylinder head is exposed to compressive stresses acting radially inwards in the region between the valve seats and a surface facing the combustion chamber by a circular ring shrink fitted on the cylinder head in the region of the valve seats and concentrically to the axis of a cylinder.

2 Claims, 3 Drawing Figures

METHOD AND MEANS FOR PREVENTING VALVE BRIDGE CRACKS IN CYLINDER HEADS OF INTERNAL COMBUSTION ENGINES

This invention relates to a method and means for preventing cracks in valve bridge portions in the cylinder head of internal combustion engines.

It has been known to subject the valve bridge portions between the pertaining valves of internal combustion engines to a tensile prestressing. For this purpose, a ring having a lower thermal expansion than the material of the surrounding cylinder head is integrally cast into the cylinder head face or bottom. Upon cooling after casting, due to its lower thermal expansion coefficient, this ring will cause a tensile stress at its inner side in the region of the cylinder head face or bottom within the ring. In order to ensure reliable transfer of the attendant tensile forces, dovetail grooves have been machined in the cylinder head to achieve a form-locking interconnection between the ring and the cylinder head. Such a method is difficult to translate into commercial practice because of obvious difficulties in machining such dovetail grooves in practice. Such a method is not applicable to cylinder heads of Diesel engines which are usually made of cast iron which, while inherently capable of taking high compressive stresses, is sensitive to tensile stresses. Thus the known method referred to is contrary to the positive properties of cast iron normally used for cylinder heads.

It is an object of the present invention to avoid cracks of the valve bridge portions which cracks occur due to thermal stresses in internal combustion engines.

This object, and other objects and advantages of the invention will appear more clearly from the following specification in connection with the accompanying drawings, in which:

FIG. 2 is a section along line II—II in FIG. 1 through the cylinder head with a circular ring shrunk on;

The invention is characterized primarily by exposing the cylinder head in the region between the valve seats and a surface facing the combustion chamber to compressive stresses acting radially inwardly.

The device according to the invention includes a circular ring shrink fitted in the cylinder head in the region of the valve seats and concentrically to the axis of a cylinder.

The device according to the present invention will enable stress conditions to be set up and/or controlled in the valve bridge portion of a cylinder head equipped therewith which conditions will fully warrant the implementation of the method according to the invention.

Figure 1:
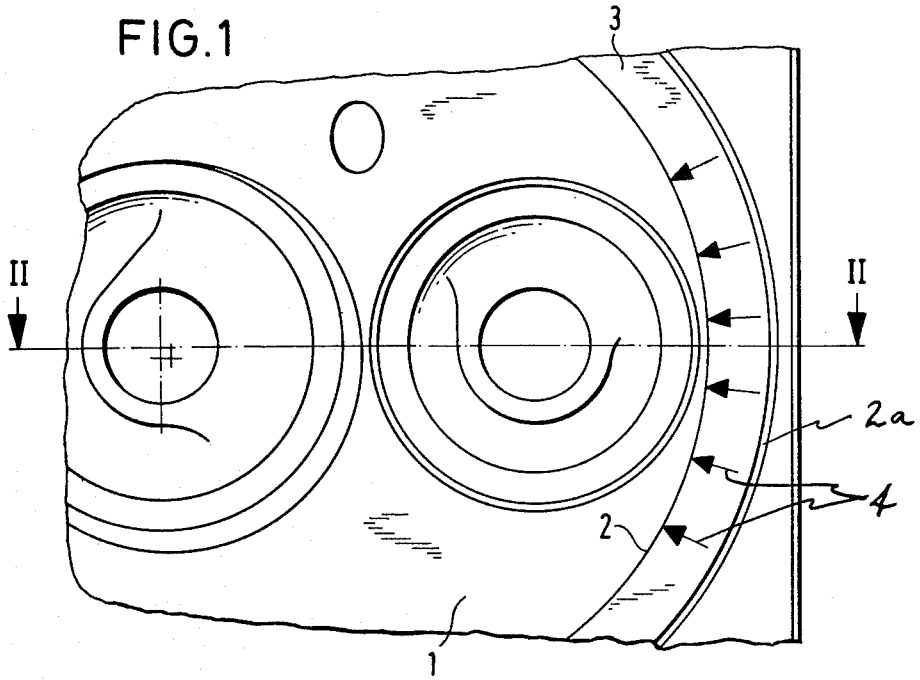
FIG. 1 is a plan view of the cylinder head viewed from the combustion chamber side.
Figure 2:
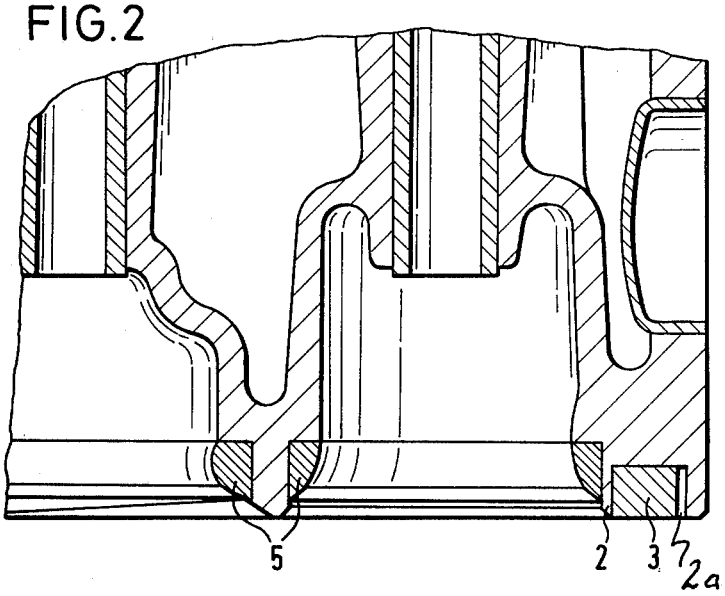

Referring particularly to the drawings, FIGS. 1 and 2 show a cylinder head 1 including a shoulder 2 which extends concentrically to the axis of a cylinder, not shown. A circular ring 3, having a generally rectangular cross section, is shrink fitted in a pertaining groove so as to leave a gap 2*a*.

The ring 3, upon cooling, provides compressive stresses or stress conditions within the entire region of the cylinder head 1, in particular also in the region of the valve bridge portion of adjacent valves, not shown, associated with valve seat rings designated by the numeral 5. The external pressure the cylinder head portion embraced or encircled by the ring 3. This external pressure is operative or effective due to the pertaining shrinkage or contraction pressure and is represented in FIG. 1 by the arrows 4 pointing towards the axis of the cylinder, not shown.

Figure 3:
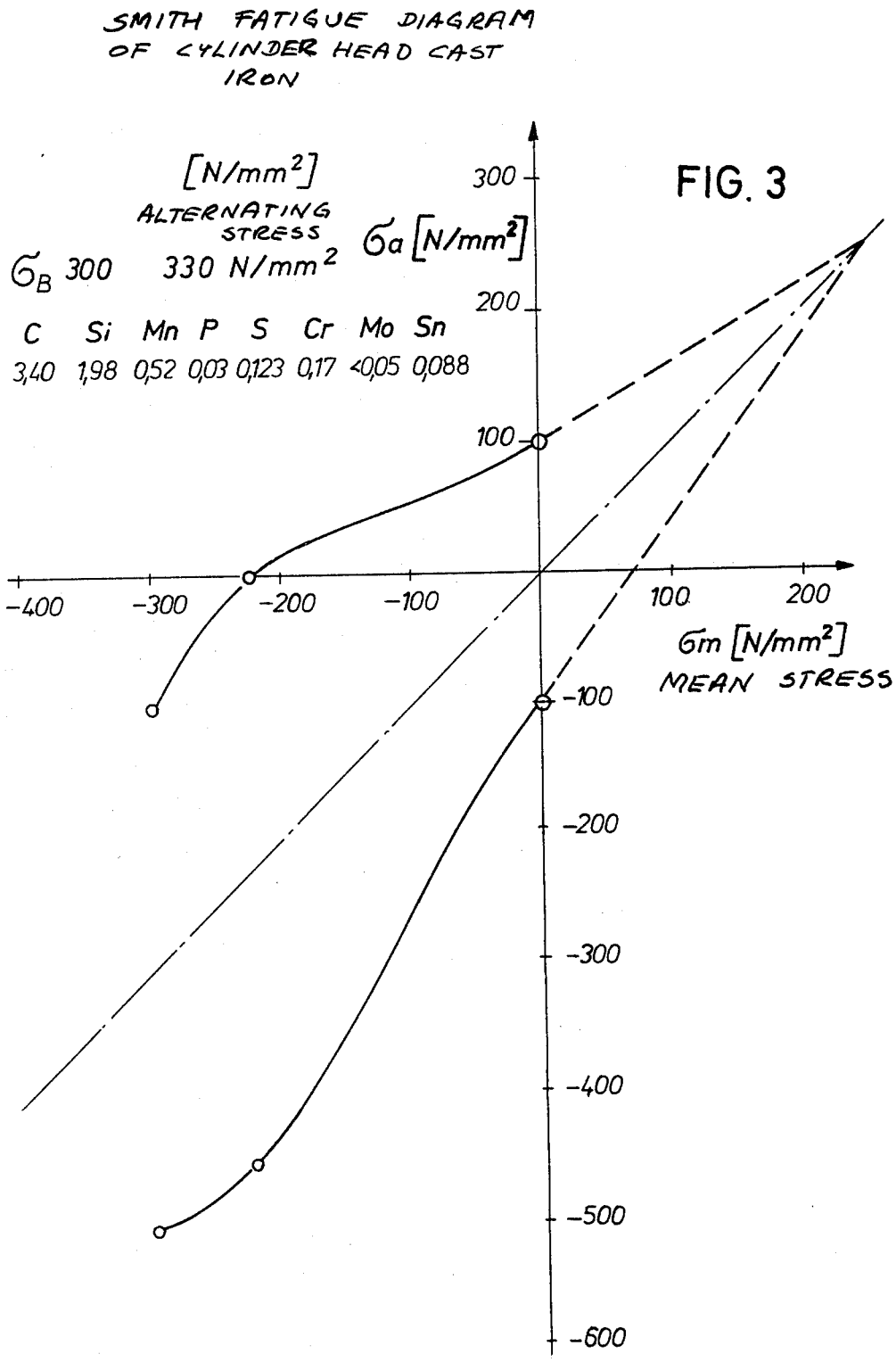
FIG. 3 is a Smith graph for the cast iron used for cylinder heads.

FIG. 3 shows a Smith fatigue diagram from which the fact that the fatigue strength is a function of the mean stress can be clearly seen. In the case of a tensile mean stress, the fatigue strength endured permanently will be only low. This negative property of cast iron compared to steel is an important factor contributing towards the formation of valve bridge cracks. If a compressive prestress is applied to the area of the valve bridge susceptible to cracking by the method and device according to the invention, the positive property of cast iron which can be clearly seen in the graph is utilized advantageously. This property consists in the high fatigue strength at conditions of compressive prestressing.

The invention provides and maintains a compressive prestressing in the entire region of a surface subjected to alternating temperature stressing, in particular the region between the valve seats, in order to generally prevent the occurrence of tensile stresses (inherent cast iron stresses or shrinkage stresses in the seat rings). The cast iron used for cylinder heads is capable of withstanding a large number of load cycles in the range of compressive stresses, but not in the range of tensile stresses. Consequently, the method according to the present invention advantageously enhances the positive physical properties of cast iron by preventing tensile stresses by the provision of impressed or predetermined, superimposed, compressive stresses. As a result, the service life of the cylinder head is automatically substantially enhanced at least with respect to the valve bridge portion thereof. The grey cast iron material used for cylinder heads is capable of withstanding a high alternating stress superimposed on a mean compressive stress under fatigue conditions. This is evident on the basis of the Smith diagram of this material. Without a mean compressive stress, the alternating stresses sustained are very low which would imply the destruction of a component stressed in this regime. Despite appropriate measures to attain a mean compressive stress, residual tensile stresses may arise at the combustion chamber end of the cylinder head, causing cracks in the valve bridge portion due to creep phenomena (surface temperature being 700° K.) during a period of cooling. However, the valve bridge crack is limited to the upper surface of the combustion chamber and fails to penetrate deeply, because the temperature is reduced rapidly to below the temperature level at which material creep is likely to occur. Thus the extent of a crack would be limited to a thin surface layer.

The device or means according to the invention provides the advantage that a simple, yet reliable, measure will ensure a continuously-acting, compressive stressing in the region between the valves and the side of the cylinder head facing the combustion chamber.

The present invention is, of course, in no way restricted to the specific disclosure of the specification and drawings, but also encompasses any modifications within the scope of the appended claims.

What I claim is:

1. In a method applicable particularly to cylinder heads of Diesel engines for preventing valve bridge cracks between valve ports in cast metal of cylinder heads of internal combustion engines including a cylinder with an axis, valve seats, and a surface facing a combustion chamber as well as having at least two spaced-apart valve ports with the cylinder head being exposed to compressive stresses acting radially inwardly in a region between the valve seats and the surface facing the combustion chamber, and including the step of:

providing an annular groove spaced radially outwardly of the valve ports within the surface of the cylinder head intended to be directed towards the combustion chamber of an internal combustion engine; and the improvement in combination therewith comprising the step of:

inserting ring means shrink fitted into the groove of the cylinder head for exerting radially inwardly directed superimposed compressive prestressing entirely in the region of the valve seats and concentrically to the axis of the cylinder subjected to alternating temperature stressing to prevent valve bridge cracks under fatigue conditions.

2. Apparatus applicable particularly to cylinder heads of Diesel engines for preventing valve bridge cracks between valve ports in cast metal cylinder heads of internal combustion engines including a cylinder with an axis, valve seats, and a surface facing a combustion chamber as well as having at least two spaced-apart valve ports with the cylinder head being exposed to compressive stresses acting radially inwardly in a region between the valve seats and the surface facing the combustion chamber, the improvement in combination therewith comprising: means forming an annular groove spaced radially outwardly of said valve ports within the surface of said cylinder head intended to be directed towards the combustion chamber of an internal combustion engine; and at least one annular member shrink fitted in said means forming the annular groove and positioned concentrically to the axis of the cylinder for exerting radially inwardly directed superimposed compressive prestresses entirely in the region of the valve seats subjected to alternating temperature stresses to prevent valve bridge cracks under fatigue conditions.

* * * * *